US006243673B1

(12) United States Patent
Ohno

(10) Patent No.: US 6,243,673 B1
(45) Date of Patent: Jun. 5, 2001

(54) SPEECH CODING APPARATUS AND PITCH PREDICTION METHOD OF INPUT SPEECH SIGNAL

(75) Inventor: Motoyasu Ohno, Tokyo (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/153,299

(22) Filed: Sep. 15, 1998

(30) Foreign Application Priority Data

Sep. 20, 1997 (JP) ..... 9-273738

(51) Int. Cl.[7] ..... G10L 21/00
(52) U.S. Cl. ..... 704/207; 704/219
(58) Field of Search ..... 704/219, 220, 704/222, 207

(56) References Cited

U.S. PATENT DOCUMENTS 5,179,594 * 1/1993 Yip et al. ..... 704/219
5,195,168 * 3/1993 Yong ..... 704/201
5,265,190 * 11/1993 Yip et al. ..... 704/219
5,396,576 * 3/1995 Miki et al. ..... 704/222
5,495,555 * 2/1996 Swaminathan ..... 704/207
5,583,963 * 12/1996 Lozach ..... 704/219

FOREIGN PATENT DOCUMENTS 758123 2/1997 (EP) .
7-20896 1/1995 (JP) .
19 74139 4/1997 (WO) .

OTHER PUBLICATIONS

English Language Abstract of JP–7–20896.
Veenerman, D. and Mazor, B., "Efficient Multi–Tap Pitch Prediction for Stochastic Coding, "pp. 225–229 (Jan 1,1993) XP000470445.

* cited by examiner

*Primary Examiner*—Fan Tsang
*Assistant Examiner*—Michael N. Opsasnick
(74) *Attorney, Agent, or Firm*—Greenblum & Bernstein, P.L.C.

(57) ABSTRACT

The speech coding apparatus comprises a memory to store the convolution data of a pitch reproduced excitation pulse sequence extracted from an excitation pulse sequence in the pitch reproduction processing with a coefficient of linear predictive synthesis filter. When the convolution processing is repeated again, the speech apparatus performs the memory control to write a part of the previous convolution data in a storing area of current convolution data, then performs the pitch prediction processing using the current convolution data.

10 Claims, 5 Drawing Sheets

SPEECH CODING APPARATUS AND PITCH PREDICTION METHOD OF INPUT SPEECH SIGNAL

BACKGROUND OF THE INVENTION

1. Field of the Invention

The present invention relates to a speech coding apparatus and a pitch prediction method in speech coding, particularly a speech coding apparatus using a pitch prediction method in which pitch information concerning an input excitation waveform for speech coding is obtained as few computations as possible, and a pitch prediction method of an input speech signal.

2. Description of the Related Art

A speech coding method represented by CELP (Code Excited Linear Prediction) system is performed by modelimg the speech information using a speech waveform and an excitation waveform, and coding the spectrum envelop information corresponding to the speech waveform, and the pitch information corresponding to the excitation waveform separately, both of which are extracted from input speech information divided into frames.

As a method to perform such speech coding at a low bit rate, recently ITU-T/G.723.1 was recommended. The coding according to G.723.1 is carried out based on the principles of linear prediction analysis-by-synthesis to attempt so that a perceptually weighted error signal is minimized. The search of pitch information in this case is performed by using the characteristics that a speech waveform changes periodically in a vowel range corresponding to the vibration of a vocal cord, which is called pitch prediction.

An explanation is given to a pitch prediction method applied in a conventional speech coding apparatus with reference to FIG 1. FIG. 1 is a block diagram of a pitch prediction section in a conventional speech coding apparatus.

An input speech signal is processed to be divided into frames and sub-frames. An excitation pulse sequence X[n] generated in a immediately before sub-frame is input to pitch reproduction processing section 1, and processed by the pitch emphasis processing for a current target sub-frame.

Linear predictive synthesis filter 2 provides at multiplier 3 the system filter processing such as formant processing and harmonic shaping processing to an output speech data Y[n] from pitch reproduction processing section 1.

The coefficient setting of this linear predictive synthesis filter 2 is performed using a linear predictive coefficient A'(z) normalized by the LSP (linear spectrum pair) quantization of a linear predictive coefficient A(z) obtained by linear predictive analyzing a speech input signal y[n], a perceptual weighting coefficient W[z] used in perceptual weighting processing the input speech signal y[n], and a coefficient P(z) signal of harmonic noise filter for waveform arranging a perceptually weighted signal.

Pitch predictive filter 4 is a filter with five taps for providing in multiplier 5 the filter processing to an output data t'[n] out put from multiplier 3 using a predetermined coefficient. This coefficient setting is performed by reading out a codeword sequentially from adaptive codebook 6 in which a codeword of adaptive vector corresponding to each pitch period is stored. Further when coded speech data are decoded, this pitch predictive filter 4 has the function to generate a pitch period which sounds more natural and similar to a human speech in generating a current excitation pulse sequence from a previous excitation pulse sequence.

Further adder 7 outputs an error signal r[n]. The error signal r[n] is an error between an output data p[n] from multiplier 5 that is a pitch predictive filtering processed signal, and a pitch residual signal t[n] of a current sub-frame (a residual signal of the formant processing and the harmonic shaping processing). An index in adaptive codebook 6 and a pitch length are obtained as the optimal pitch information so that the error signal r[n] should be minimized by the least squares method.

The calculation processing in a pitch prediction method described above is performed in the following way.

First the calculation processing of pitch reproduction performed in pitch reproduction processing section 2 is explained briefly using FIG. 1.

The excitation pulse sequence X[n] of a certain pitch is sequentially input to a buffer to which 145 samples can be input, then the pitch reproduced excitation sequence Y[n] of 64 samples are obtained according to equations (1) and (2) below, where Lag indicates a pitch period.

$$Y(n)=X(145-\text{Lag}-2+n)\quad n=0,1 \tag{1}$$

$$Y(n)=X(145-\text{Lag}+(n-2)\%\text{Lag})\quad n=2-63 \tag{2}$$

That is, equations (1) and (2) indicate that a current pitch information (vocal cord vibration) is imitated using a previous excitation pulse sequence.

Further, the convolution data (filtered data) t'[n] is obtained by the convolution of this pitch reproduced excitation sequence Y[n] and an output from linear predictive synthesis filter 2 according to equation (3) below.

$$t'(n)=\sum_{j=0}^{n} I(j)\cdot Y(n-j)\quad 0\le n\le 59 \tag{3}$$

And, since the pitch prediction processing is performed using a pitch predictive filter in fifth order FIR (finitive impulse response) type, five convolution data t'[n] are necessary from Lag−2 up to Lag+2 as shown in equation (4) below, where Lag is a current pitch period.

Because of the processing, as shown in FIG. 2, the pitch reproduced excitation data Y[n] requires 64 samples which are 4 samples (from Lag−2 up to Lag+2 suggests total 4 samples) more than 60 samples forming a sub-frames, $$t'(l)(n)=\sum_{j=0}^{n} I(j)\cdot Y(l+n-j)\quad 0\le l\le 4\quad 0\le n\le 59 \tag{4}$$

where l is a variable of two dimensional matrix, which indicates the processing is repeated five times.

However, as a method to reduce calculations in a DSP or the like, convolution data t'(4)(n) is obtained using equation (3) when l=4, and obtained using equation (5) below when l=0~3.

$$t'(l)(n)=I(l)\cdot Y(n)+t'(l+1)(n-1)\quad 0\le l\le 3\quad 0\le n\le 59 \tag{5}$$

By using equation (5), 60 times of convolution processing are enough, while 1,830 times of convolution processing are required without using equation (5).

Further the optimal value of convolution data P(n) in pitch predictive filter 4 is obtained using pitch residual signal t(n) so that the error signal r(n) should be minimized. In other words, the error signal r(n) shown in equation (6) below should be minimized by searching adaptive codebook data of pitches corresponding to Live filter coefficients of fifth order FIR type pitch predictive filter 4 from codebook 6.

$$r(n)=t(n)-p(n) \tag{6}$$

The estimation of error is obtained using the least squares method according to equation (7) below.

$$\sum_{n=0}^{59} |r(n)|^2 \tag{7}$$

Accordingly, equation (8) below is given.

$$\sum_{n=0}^{59} |r(n)|^2 = \sum_{n=0}^{59} |t(n) - p(n)|^2 = \sum_{n=0}^{59} t(n)^2 - 2t(n) \cdot p(n) + p(n)^2 \tag{8}$$

Further, equation (9) below is given.

$$p(n) = \sum_{l=0}^{4} t'(l)(n) \quad 0 \le n \le 59 \tag{8}$$

By substituting equation 9 in equation 9, adaptive codebook data of a pitch, in other words, the index of adaptive codebook data of a pitch to minimize the error is obtained.

Further pitch information that is closed loop pitch information and the index of adaptive code book data of a pitch are obtained by repeating the above operation corresponding to Lag−1 up to Lag+1 for the re-search so as to obtain the pitch period information at this time correctly. The number of re-search times is determined by the setting of k parameter. In the case of repeating a pitch prediction according to the order of Lag−1, Lag, and Lag+1, k is set at 2 (0,1 and 2). (In the case of k=2, the number of repeating times is 3.)

The further processing is provided to each sub-frame. The re-search range of a pitch period for an even-numbered sub-frame is from Lag−1 to Lag+1, which sets k=2 (the number of repeating times is 3). The re-search range of a pitch period for an odd-numbered sub-frame is from Lag−1 to Lag+2, which sets k=3 (the number of repeating times is 4). The pitch search processing is performed according to the range described above, and since one frame is composed of four sub-frames, the same processing is repeated four times in one frame.

However in the constitution according to the prior art described above, since the convolution processing shown in equation 4 is necessary each time of the pitch reproduction processing, the required number of convolution processing times in one frame is 14 (3+4+3+4) that is the total amount suggested by the k parameter. That brings the problem that the computations are increased in the case where the processing is performed in DSP (CPU).

And it is necessary to repeat the pitch reproduction processing at the number of times corresponding to the k parameter. That also brings the problem that the computations are increased in the case where the processing is performed in DSP (CPU).

SUMMARY OF THE INVENTION

The present invention is carried out by considering the above subjects. It is an object of the present invention to provide a speech coding apparatus using the pitch prediction method capable of reducing the computations in DSP (CPU) without depending on the k parameter.

The present invention provides a speech coding apparatus comprises a memory to store the convolution data after convolution calculation using a pitch reproduced excitation pulse sequence extracted from an excitation pulse sequence in the pitch reproduction processing and a coefficient of linear predictive synthesis filter, and when the convolution processing is repeated again, performs the memory control to write a part of the previous convolution data in a storing area of current convolution data, then performs the pitch prediction processing using the current convolution data.

In the speech coding apparatus, since the convolution data are controlled in a memory, the convolution processing, which requires the plurality of computations corresponding to the number of repeating times set by the k parameter, is completed with only one computation. That allows reducing the computations in a CPU.

And the present invention is to store in advance a plurality of pitch reproduced excitation pulse sequences, to which the pitch reproduction processing is provided, corresponding to a plurality of pitch searches, and to perform the convolution processing sequentially by reading the pitch reproduced excitation pulse from the memory.

In the speech coding apparatus, it is not necessary to perform the pitch reproduction in pitch searches after the first pitch search, the pitch searches are simplified since the second time. And since it is not necessary to repeat the pitch reproduction processing according to the k parameter, it is possible to reduce the calculation amount in a CPU.

DETAILED DESCRIPTION OF THE PREFERRED EMBODIMENTS (First Embodiment)

Figure 3:
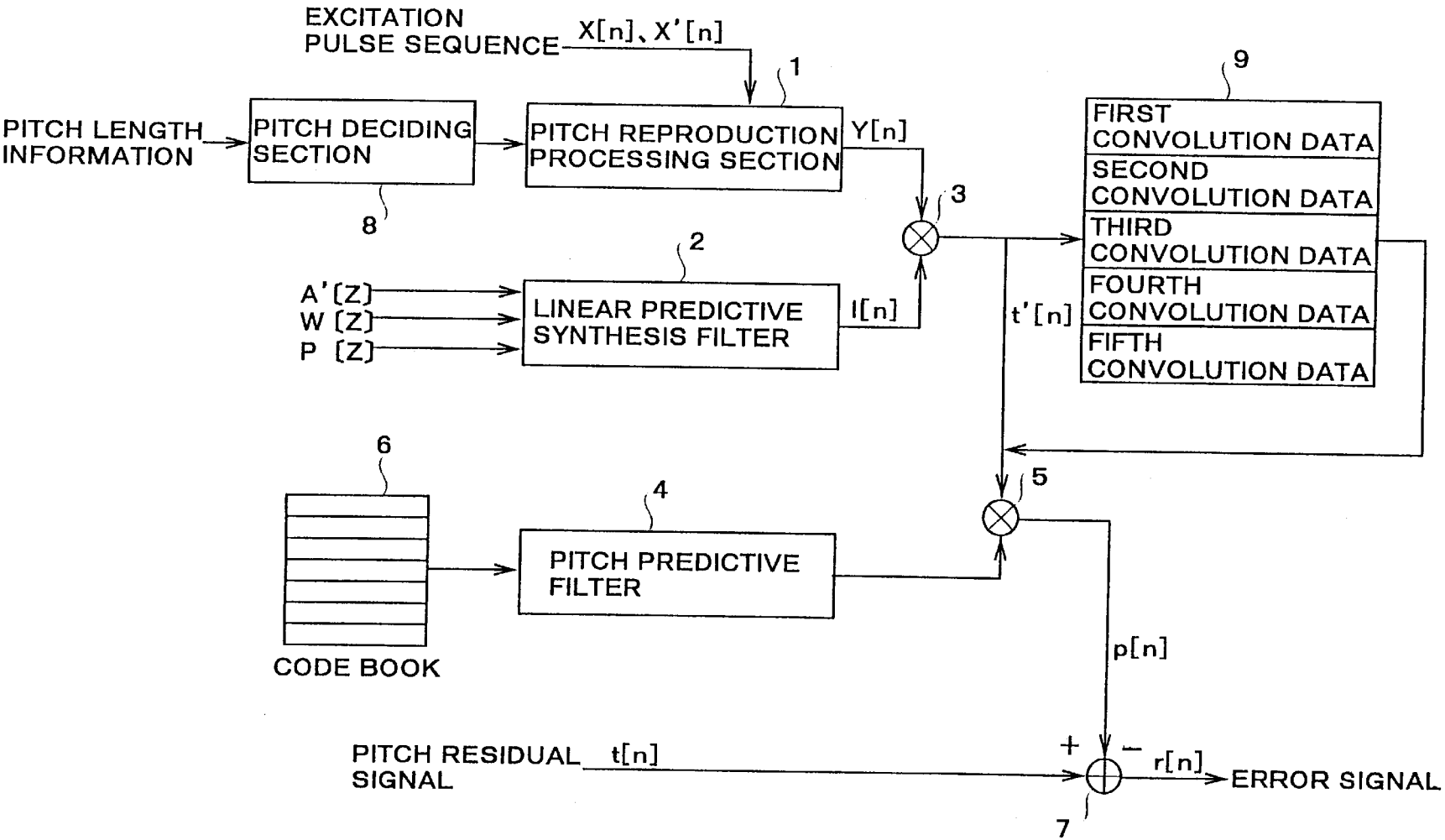
FIG. 3 is a block diagram of a pitch prediction section in a speech coding apparatus in the first embodiment of the present invention.

Hereinafter the first embodiment of the present invention is explained with reference to drawings. FIG. 3 is a schematic block diagram of a pitch prediction section in a speech coding apparatus in the first embodiment of the present invention.

The flow of the basic coding processing in the apparatus is the same as in a conventional apparatus. An excitation pulse sequence X[n] generated in a just-previous sub-frame is input pitch reproduction processing section 1. Pitch reproduction processing section 1 provides the pitch emphasis processing for a current object sub-frame using the input X[n] based on the pitch length information obtained by the auto-correlation of the input speech waveform. And linear predictive synthesis filter 2 provides at multiplier 3 the system filter processing such as formant processing and harmonic shaping processing to an output speech data Y[n] from pitch reproduction processing section 1.

The coefficient setting of this linear predictive synthesis filter 2 is performed using a linear predictive coefficient A'(z) normalized by the LSP quantization, a perceptual weighting coefficient W[z] and a coefficient P(z) signal of harmonic noise filter.

Pitch predictive filter 4 is a filter with five taps for providing in multiplier 5 the filter processing to an output data t'[n] in multiplier 3 using a predetermined coefficient. This coefficient setting is performed by reading a codeword sequentially from adaptive codebook 6 in which a codeword of adaptive vector corresponding to each pitch period is stored.

Further adder 7 outputs an error signal r[n] The error signal r[n] is an error between an output data p[n] from multiplier 5 that is a pitch predictive filter processed signal, and a pitch residual signal t[n] of the current sub-frame (a residual signal after the formant processing and the harmonic shaping processing). An index in adaptive codebook 6 and a pitch length are obtained as the optimal pitch information so that the error signal r[n] is minimized by the least squares method.

And pitch deciding section 8 detects the pitch period (Lag) from the input pitch length information, and decides whether or not the value exceeds the predetermined value. In the first embodiment, since it is assumed that one sub-frame is composed of 60 samples, one period is more than one sub-frame, and pitch predictive filter is composed of 5 taps, it is necessary to extract 5 sub-frames continuously by shifting a sub-frame from Lag+2 each sample, which results in Lag+2>64. Further the same processing is repeated the number of times set by the k parameter (in the case of k=2, the processing is repeated three times) to improve the precision of the pitch reproduced excitation data Y[n]. Accordingly, pitch deciding processing section 8 performs the decision of Lag+2>64+k (Lag>62+k).

Figure 1:
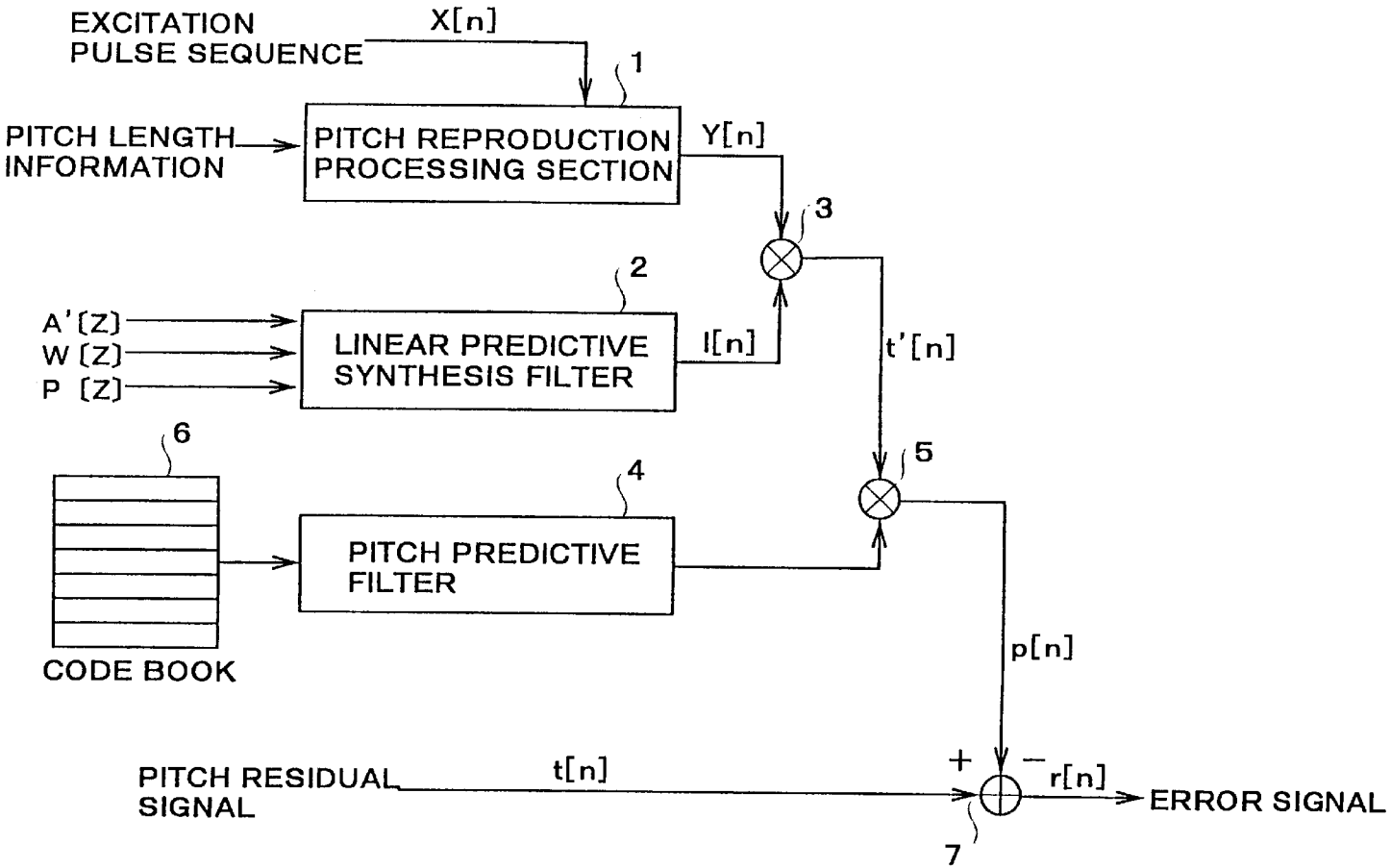
FIG. 1 is a block diagram of a pitch prediction section of a conventional speech coding apparatus.
Figure 2:
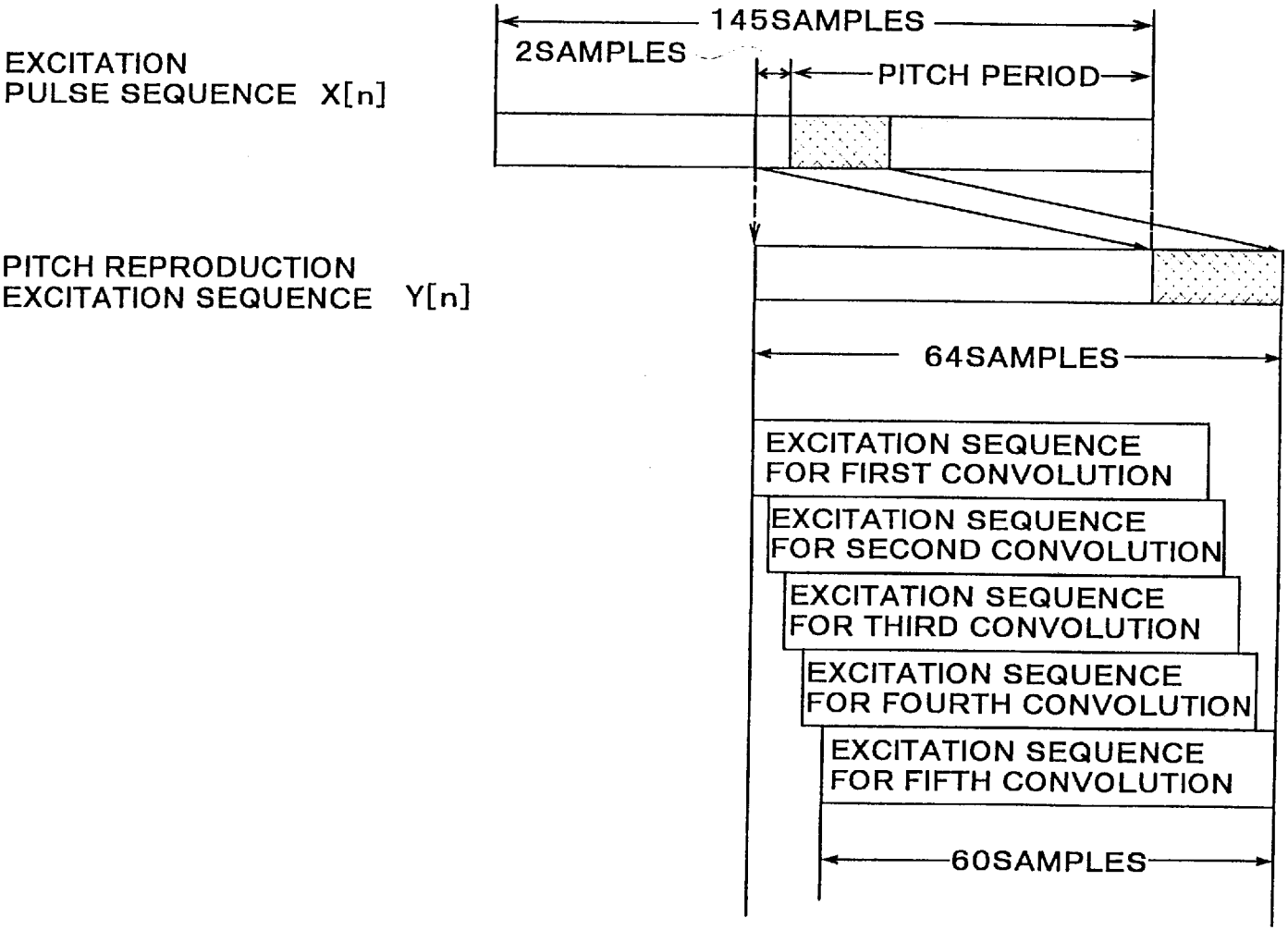
FIG. 2 is an exemplary diagram illustrating the state in generating a pitch reproduced excitation sequence.

And memory 9 is to store the convolution data of the pitch reproduced excitation data Y[n] and a coefficient I[n] of linear predictive synthesis filter 2. As illustrated in FIG. 1, first convolution data up to fifth convolution data are sequentially stored in memory 9 corresponding to the repeating times of pitch reproduction set by the k parameter and the convolution. In this repeating processing, an excitation pulse sequence X'[n] is feedback to pitch reproduction processing section 2, using pitch information acquired at the previous processing. The excitation pulse sequence X'[n] is generated from an error signal between the convolution data of the coefficient of pitch predictive filter 4 using the previous convolution data and pitch residual signal t[n].

A detailed explanation is given to the pitch prediction processing in a speech coding apparatus constituted as described above.

The processing up to obtain each convolution data of t'(4)(n) according to equation (3) and equation (5) in the first embodiment is the same as that in a conventional technology. In the first embodiment, the previous pitch reproduction processing result is used again in the case where pitch period Lag is more than a predetermined value when re-search is performed k times by repeating the convolution processing using linear predictive synthesis filter 2 to improve the reproduction precision of a pitch period. That is attempted to reduce the computations.

In detail, in the case where the pitch period Lag and the k parameter meet Lag>62+k in pitch deciding section 8, the second pitch reproduction processing is performed in the order of Lag+1, lag and Lag−1 according to equation (10) and equation (11) below. In the case of k=2, the second and third pitch re-search processing is performed in the same manner.

$$Y(n)=X(145-\text{Lag}-4+k)\ n=0 \tag{10}$$

$$\text{i}\ Y(n)=Y(n-1)\ n=1-63 \tag{11}$$

In a series of the pitch reproduction processing, this convolution is performed 5 times according to equation (4) and equation (5). The convolution data are sequentially stored in memory 9. The previous convolution data stored in memory 9 is used in the convolution processing at this time.

In other words, since the convolution data are fetched by shifting each one sample according to the tap composition of a pitch predictive filter, the fourth convolution data at the previous time are the fifth convolution data at this time, the third convolution data at the previous time are the fourth convolution data at this time, the second convolution data at the previous time are third convolution data at this time, the first convolution data at the previous time are the second convolution data at this time. Accordingly the convolution data newly needed in the processing at this time is acquired by computing only the case of I=0 in equation (5).

Figure 4A:
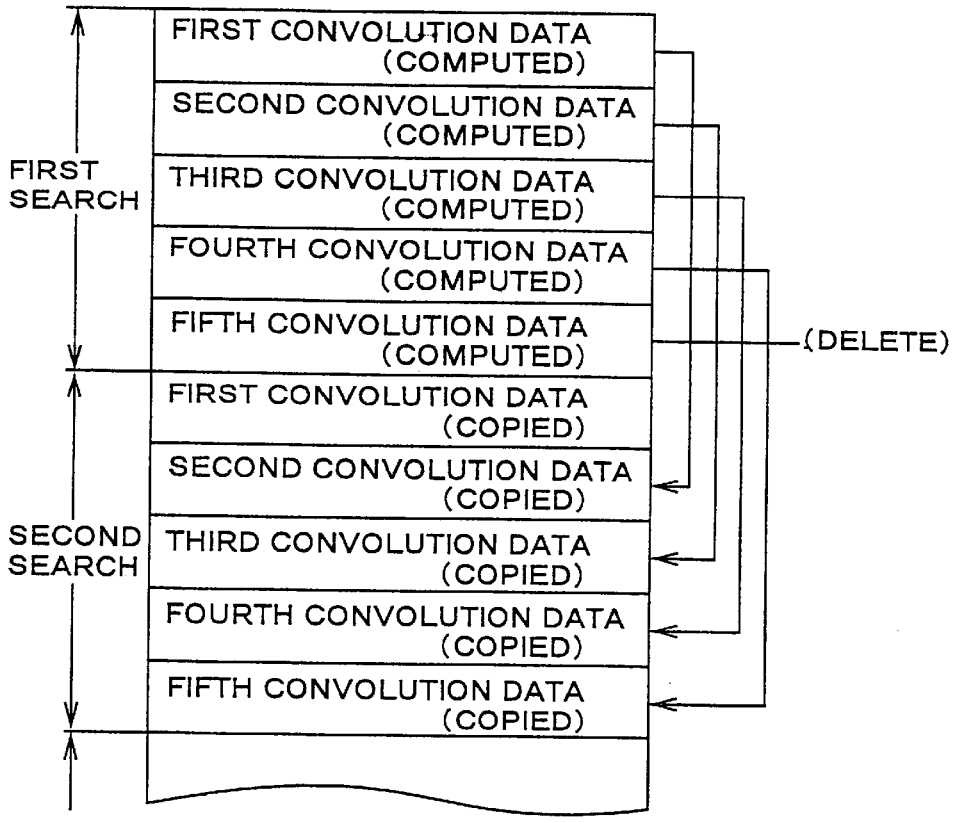
FIG. 4A is an exemplary diagram illustrating a memory to store convolution data in a speech coding apparatus in the first embodiment.

In the second re-search processing, the first convolution data are newly computed and stored in memory 9 as illustrated in FIG. 4A. As the second convolution data up to the fifth convolution data, the first convolution data up to the fourth convolution data obtained in the first search processing are each copied and respectively stored in the second search data write area in memory 9. That allows reducing the computations.

In the processing described above, to achieve the result of equation (4) which requires 1,830 times of computations in a conventional method, just one convolution computation in a sub-frame is enough to achieve. Thus, it is possible to acquire the precise convolution data promptly with fewer computations.

Figure 4B:
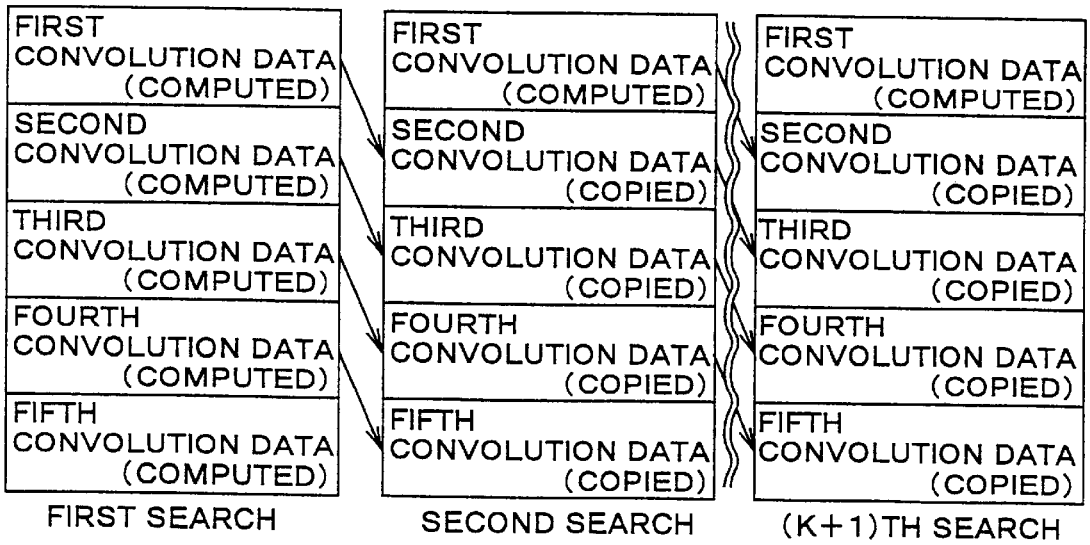
FIG. 4B is an exemplary diagram illustrating the state in shifting convolution data in the memory in a speech coding apparatus in the first embodiment.

And as a data storing area, it is enough to prepare the areas for the first convolution up to the fifth convolution necessary for one search processing. As illustrated in FIG. 4B, first, the fourth convolution data are stored in a storing area for the fifth convolution data that will be unnecessary, then the third and second data are stored sequentially, and finally the first convolution data are computed to store. Thus, it is possible to reduce the memory areas.

That is, it is not necessary to prepare the number of convolution storing areas corresponding to the number of k that is the repeating times set by the k parameter. In the repeating processing, the pitch predictive processing can be always performed with five storing areas for the convolution data, which are at least necessary for the fifth order FIR.

In addition, a memory controller in memory 9 performs the processing described above, i.e., the write of the convolution data to memory 9, the shift of the convolution data in memory 9, and the read of convolution data used in the current pitch search from memory 9. The memory controller is one of functions of memory 9.

The convolution data obtained as described above are returned to a pitch reproduction processing section as closed loop pitch information to be processed by the pitch reproduction processing, and are processed by the convolution processing with the filter coefficient set for linear predictive synthesis filter 2. Such processing is repeated corresponding to the number of repeating times set by the k parameter. That permits to improve the precision of the pitch reproduction excitation sequence t'[n] to be inputted to multiplier 5.

In addition, the above explanation is given to the case of meeting the condition of Lag>62+k. In the case of Lag≦62+k, it is necessary to repeat the convolution processing of equation (4), which is required 1,830 times that are k+1 times corresponding to the repeating times set by the k parameter, every time.

(Second Embodiment)

Figure 5:
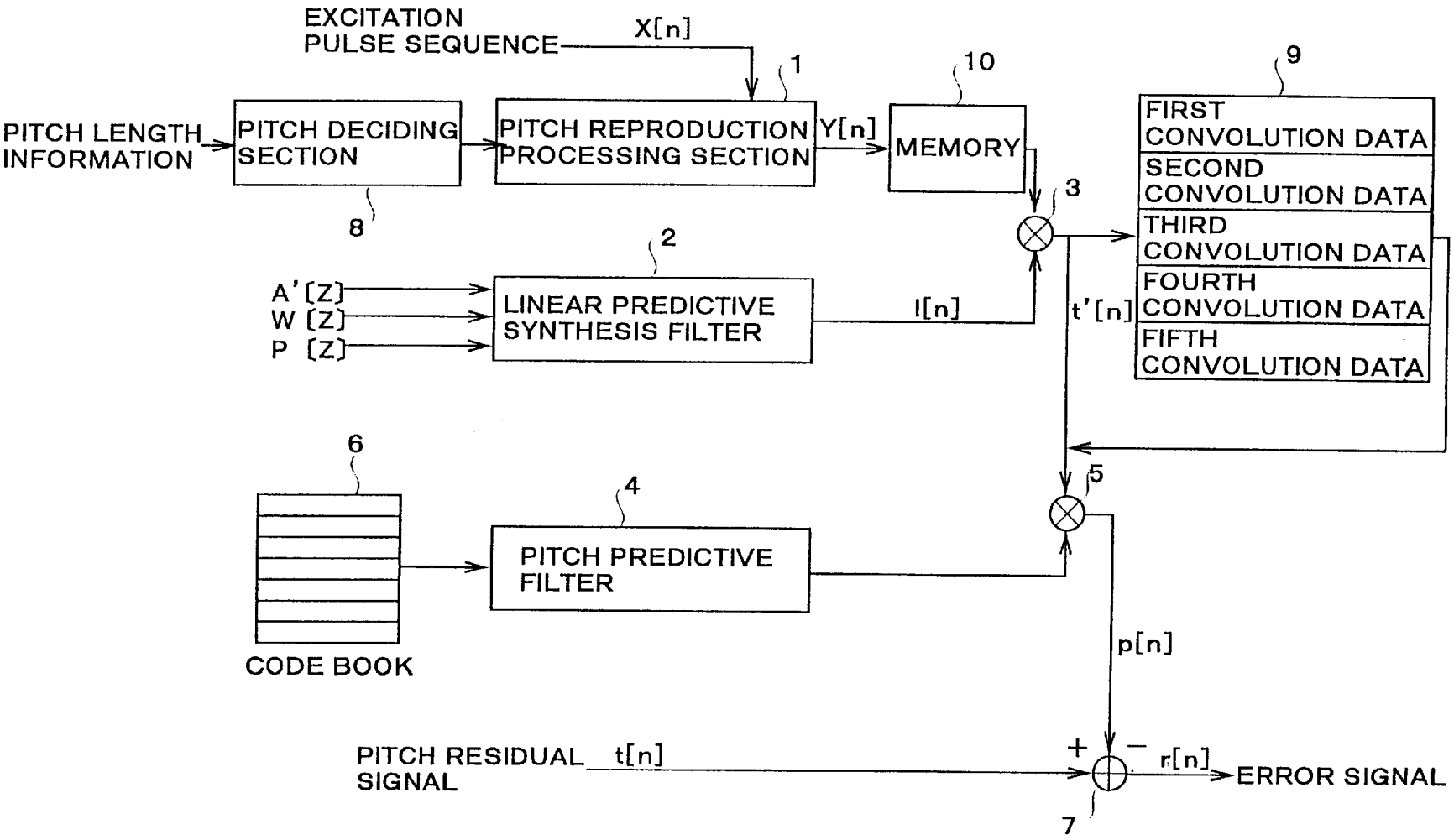
FIG. 5 is a block diagram of a pitch prediction section in a speech coding apparatus in the second embodiment of the present invention.

A following explanation is given to a speech coding apparatus in the second embodiment of the present invention using FIG. 5.

In the second embodiment, by preparing memory 10 for temporarily storing the pitch reproduced excitation sequence t'[n] after pitch reproduction processing section 2, it is designed not to repeat the pitch reproduction processing the repeating times set by the k parameter.

In the case of meeting the condition of lag>62+k in the pitch deciding processing in the same manner as the first embodiment, it is possible to acquire k+1 numbers of the pitch reproduction excitation sequences corresponding to the repeating times set by the k parameter once (before the pitch search) according to equation 12 and equation 13 to store in memory 10.

$$Y(n)=X(145-\mathrm{Lag}k+n)\ n=0-(k-1) \tag{12}$$

$$Y(n)=X(145-\mathrm{Lag}+(n-k)\%\mathrm{Lag})n=k-(61+k) \tag{13}$$

By storing k+1 numbers of pitch reproduced excitation sequences in memory 10 in advance, it is not necessary to repeat the pitch reproduction processing in pitch reproduction processing section 2 the number of repeating times set by the k parameter. Accordingly it is possible to successively generate the first convolution data up to the fifth convolution data in multiplier 3, which allows reducing the load of computations.

What is claimed is:

1. A speech coding apparatus, comprising:

a generator that generates a pitch reproduced excitation pulse sequence that simulates a pitch on a current subframe using an excitation pulse sequence generated on a last subframe at a first search operation, while generating said pitch reproduced excitation pulse sequence at subsequent searches using an excitation pulse sequence obtained at a just prior search operation;

a linear predictive synthesis filter that obtains a convolution calculation result by performing a convolution calculation using setting coefficients that include linear predictive coefficients, obtained by performing a linear predictive analysis on a speech input signal, perceptual weighted coefficients, used in performing perceptual weighting on said speech input signal, and said pitch reproduced excitation pulse sequence;

a memory that stores said convolution calculation result obtained by said linear predictive synthesis filter;

an adaptive codebook that stores previously generated excitation pulse sequences as adaptive vectors;

a pitch predictive filter that reads an adaptive vector from said adaptive codebook, said pitch predictive filter outputting a multiplication result obtained by multiplying said convolution calculation result by said read adaptive vector;

a detector that detects an error between each output multiplication result and a pitch residual signal, when said adaptive vector is sequentially read from said adaptive codebook while a position of said adaptive vector to be read is varied, said detector detecting a read position that minimizes said error as an optimal pitch length; and a controller that controls, at said first search operation, a storing in said memory of first to Nth convolution calculation results corresponding to first to Nth excitation pulse sequences, said first to Nth excitation pulse sequences being obtained by sequentially shifting one sample, said stored first to Nth convolution calculation results being provided to said pitch predictive filter, while at subsequent search operations, said controller controls a storing of a convolution calculation result corresponding to a temporary excitation pulse sequence temporarily generated at said just prior search operation and provides current first to Nth convolution calculation results to said pitch predictive filter, said current first to Nth convolution calculation results comprising a convolution calculation result calculated in a current search operation as a first convolution calculation result and first to N-1th convolution calculation results stored in said memory as a second to Nth convolution calculation, wherein said linear predictive synthesis filter performs said convolution calculation N times, corresponding to the first to Nth excitation pulse sequences obtained by sequentially shifting said one sample, at said first search operation, while performing a single convolution calculation, corresponding to one excitation pulse sequence, at said subsequent search operations.

2. The speech coding apparatus of claim 1, wherein said memory has a storage capacity sufficient for storing said convolution calculation needed for a search.

3. The speech coding apparatus of claim 1, wherein said controller effects an erasure of said convolution calculation that is not used in said current search operation by shifting a plurality of convolution calculations stored in said memory, while effecting a storing of said convolution calculation to be used in said current search operation, obtained by said linear predictive synthesis filter, in a vacant area of said memory.

4. The speech coding apparatus of claim 1, further comprising:

a pitch determiner that determines whether a pitch period exceeds a predetermined value using pitch length data associated with said speech input signal, said linear predictive synthesis filter computing only said first convolution calculation after said subsequent search operation when said pitch determiner determines that said pitch period exceeds said predetermined value.

5. The speech coding apparatus of claim 1, further comprising:

an additional memory that stores a plurality of pitch reproduced excitation pulse sequences.

6. The speech coding apparatus of claim 5, wherein said pitch is reproduced from a previous excitation pulse sequence generated by said generator.

7. The speech coding apparatus of claim 5, wherein said linear predictive synthesis filter sequentially obtains said convolution computation by reading a pitch reproduced excitation pulse sequence, of said plurality of pitch reproduced excitation pulse sequences, from said additional memory.

8. A method for predicting a pitch of an input speech signal, comprising:

generating a pitch reproduced excitation pulse sequence that simulates a pitch on a current subframe using an excitation pulse sequence generated on a last subframe at a first search operation, while generating the pitch reproduced excitation pulse sequence at subsequent searches using an excitation pulse sequence obtained at a just prior search operation;

obtaining a convolution calculation result by performing a convolution calculation using setting coefficients that include linear predictive coefficients, obtained by performing a linear predictive analysis on a speech input signal, perceptual weighted coefficients, used in performing perceptual weighting on the speech input signal, and said pitch reproduced excitation pulse sequence;

storing the obtained convolution calculation result;

storing previously generated excitation pulse sequences as adaptive vectors;

reading an adaptive vector that has been stored;

multiplying the convolution calculation result by the read adaptive vector to obtain a multiplication result;

detecting an error between each obtained multiplication result and a pitch residual signal, when the adaptive vector is sequentially read, while a position of the adaptive vector to be read is varied, a read position that minimizes the error being detected as an optimal pitch length; and controlling, at the first search operation, a storing of first to Nth convolution calculation results corresponding to first to Nth excitation pulse sequences, the first to Nth excitation pulse sequences being obtained by sequentially shifting one sample, the stored first to Nth convolution calculation results being used to obtain the multiplication result, while at subsequent search operations, a convolution calculation result corresponding to a temporary excitation pulse sequence temporarily generated at the just prior search operation is stored and current first to Nth convolution calculation results are used to obtain the multiplication results, the current first to Nth convolution calculation results comprising a convolution calculation result calculated in a current search operation as a first convolution calculation result and first to N-1th convolution calculation results stored as a second to Nth convolution calculation, wherein the convolution calculation is performed N times, corresponding to the first to Nth excitation pulse sequences obtained by sequentially shifting the one sample, at the first search operation, while performing a single convolution calculation, corresponding to one excitation pulse sequence, at the subsequent search operations.

9. The method of claim 8, further comprising:

storing a plurality of pitch reproduced excitation pulse sequences, in which the pitch is reproduced from a previous excitation pulse sequence corresponding to a pitch period for each search operation.

10. The method of claim 9, further comprising:

sequentially performing the convolution calculation by reading the pitch reproduced excitation pulse sequence to be used in a pitch search after the first search operation.

* * * * *

UNITED STATES PATENT AND TRADEMARK OFFICE

CERTIFICATE OF CORRECTION

PATENT NO. : 6,243,673 B1
DATED : June 5, 2001
INVENTOR(S) : M. Ohno

It is certified that error appears in the above-identified patent and that said Letters Patent is hereby corrected as shown below:

Title page,
Item [56], References Cited, FOREIGN PATENT DOCUMENTS,
Line 4, "19 74139" should be -- 97/14139 --.

Column 8,
Line 30, "claim 1" should be -- claim 2 --.

Signed and Sealed this

Twenty-second Day of January, 2002

*Attest:*

*Attesting Officer*

JAMES E. ROGAN
*Director of the United States Patent and Trademark Office*